US006662614B1

(12) United States Patent
Lim

(10) Patent No.: US 6,662,614 B1
(45) Date of Patent: Dec. 16, 2003

(54) TOOL AND ITS FINISHING METHOD OF SURFACE FOR CENTER FIN MEMBER OF AIR CONDITIONING APPARATUS FOR VEHICLE

(75) Inventor: Sang-Won Lim, Taegu (KR)

(73) Assignee: Daewoo Automotive Components, Ltd., Taegu (KR)

( * ) Notice: Subject to any disclaimer, the term of this patent is extended or adjusted under 35 U.S.C. 154(b) by 0 days.

(21) Appl. No.: 09/857,174

(22) PCT Filed: Dec. 17, 1999

(86) PCT No.: PCT/KR99/00781

§ 371 (c)(1),
(2), (4) Date: Sep. 24, 2001

(87) PCT Pub. No.: WO00/35690

PCT Pub. Date: Jun. 22, 2000

(30) Foreign Application Priority Data

Dec. 17, 1998 (KR) ..... 98-56569

(51) Int. Cl.[7] ..... B21D 53/04
(52) U.S. Cl. ..... 72/186; 76/107.1
(58) Field of Search ..... 72/186, 462; 492/58

(56) References Cited

U.S. PATENT DOCUMENTS 3,988,955 A * 11/1976 Engel et al. ..... 76/112
4,067,219 A * 1/1978 Bianchi ..... 72/186

* cited by examiner

*Primary Examiner*—Lowell A. Larson
(74) *Attorney, Agent, or Firm*—Jacobson Holman PLLC

(57) ABSTRACT

A tool and its finishing method of surface for center fin member of an air conditioning apparatus for a vehicle. The tool includes a plurality of fin blades each having a circular cutter shape and being provided at a periphery thereof with a plurality of cutting teeth and at a central portion thereof with a central hole. The fin blades are stacked on one another in such a fashion that the central holes are aligned together, and a pair of jig discs are arranged in a coaxial and integral fashion with the fin blades. The tool serves to form louvered center fins having a plurality of continued flat wall portions formed by bending a thin strip in a desired pitch in a zig-zag fashion, each of the flat wall portions having a plurality of louvers extending in perpendicular to the flat wall portion. Respective crests are nitrified to a depth of 20 to 60 $\mu$m under the condition in which no heat treatment has been conducted for the fin blades, whereby a nitride layer exhibiting a hardness of Hv 1200 to Hv 1300 is diffused in each of the crests.

15 Claims, 9 Drawing Sheets

TOOL AND ITS FINISHING METHOD OF SURFACE FOR CENTER FIN MEMBER OF AIR CONDITIONING APPARATUS FOR VEHICLE

TECHNICAL FIELD

The present invention relates to a tool for manufacturing louvered fins for a heat exchanger and a surface finishing method for the tool, and more particularly to a tool for manufacturing louvered center fins configured to achieve an improvement in heat exchange efficiency in a variety of heat exchangers. The present invention also relates to a method for finishing the surface of such a tool.

BACKGROUND ART

In an air conditioner equipped in vehicles, a heat exchanger serves as an interface for conducting a heat exchange of the air conditioner with ambient air. Such a heat exchanger is configured in various forms, for example, in the form of a condenser, a radiator, a heater core, or an evaporator.

Although there are a variety of heat exchangers, they have similar configurations. That is, most heat exchangers include a pair of header tanks for receiving a heat exchange medium introduced therein, and a plurality of parallel heat exchange tubes arranged between the header tanks in a stacked fashion and adapted to form an elongated flow passage for the heat exchange medium.

A louvered fin having the form of a sheet is interposed between adjacent ones of the heat exchange tubes while being bonded to those adjacent heat exchange tubes. For the bonding to the heat exchange tubes, the louvered fin is coated, at both surfaces thereof, with clad layers made of a fusible metal having a low melting point.

The louvered fin is bent in a zig-zag fashion to have a corrugated structure. In order to provide a maximized heat exchange efficiency, the fin is also provided with a plurality of,parallel louvers so that it has a louvered structure. The louvers are formed by cutting each flat wall portion of the fin at a plurality of positions along the length of the flat wall portion, and then bending those cut portions from the plane of the flat wall portion. By virtue of such a louvered structure, the fin has a maximum contact area with ambient air.

Since the above mentioned fin has a corrugated and louvered sheet structure bent in a zig-zag fashion and provided with a plurality of bent louvers, it is necessary to use a specific tool for the manufacture of such a fin.

Conventionally, such a tool includes a plurality of stacked parallel fin blades each provided at its periphery with a plurality of cutting teeth arranged in a pitch corresponding to the bending pitch of a fin to be formed. The number of the fin blades corresponds to the number of louvers to be formed at each flat wall portion of the bent fin.

In order to manufacture a louvered fin, a pair of tools having. the above mentioned arrangement are used. The tools are arranged adjacent to each other to define a nip therebetween. A metal sheet made of aluminum or clad-coated aluminum exhibiting a high thermal conductivity is forced to pass through the nip between the tools, so that it is simultaneously subjected to a bending process for the formation of corrugations in a zig-zag fashion and a cutting and bending process for the formation of louvers.

The fin blades of the tools are subjected to a severe using condition in that they are repeatedly and continuously used for the repeated and continued bending and cutting processes. For this reason, it is important to lengthen the life of the fin blades.

To this end, a variety of proposals have conventionally been made. For example, fin blades are manufactured using a high-speed steel thin plate which is subjected to a quenching process to have a Vickers hardness of 700 to 750 and then subjected to a surface treatment using a gaseous nitrification method.

However, conventional surface-treated tools used for the manufacture of louvered fins for heat exchangers have the following problems:

(1) The tools are easily abraded during the manufacture of louvered fins because they rotate at a high speed. For this reason, the tools should be periodically ground;

(2) Since the article to be machined by the tools is made of a metal, such as aluminum, exhibiting a high viscosity in most cases, burrs may occur at the tooth crests of the fin blades. As a result, a considerable degradation in workability occurs;

(3) In particular, where the clad metal of the fin is an alloy material containing Si, for example, a Al—Si-based or Al—Mn—Si-based composite material, the tools may be early abraded due to Si exhibiting a very high hardness;

(4) Since each tool uses a plurality of fin blades individually manufactured and then stacked together, it is very expensive. For this reason, a frequent replacement of such a tool results in a considerable increase in costs; and (5) The frequent replacement and grinding of the tools cause a frequent temporary shut-down of the production line. Furthermore, the repeated grinding of the tools may result in a variation in the dimensions of louvered fins initially designed. As a result, it is impossible to manufacture louvered fins with an optimum heat exchange efficiency.

DISCLOSURE OF THE INVENTION

Therefore, the present invention has been made in view of the above mentioned problems involved in conventional tools used for the manufacture of louvered fins for heat exchangers and conventional surface finishing methods for those tools, and an object of the invention is to provide a tool for manufacturing louvered center fins, which has a maximized life, and a surface finishing method for the tool capable of allowing the tool to have a maximized life.

In accordance with the present invention, this object is accomplished by providing A tool for manufacturing louvered center fins of a heat exchanger and a surface finishing method for the tool, the tool including a plurality of fin blades each having a circular cutter shape and being provided at a periphery thereof with a plurality of cutting teeth and at a central portion thereof with a central hole, the fin blades being stacked on one another in such a fashion that the central holes are aligned together, and a pair of jig discs arranged at opposite sides of the stacked fin blades, respectively, in such a fashion that the jig discs are arranged in a coaxial and integral fashion with the fin blades, the tool serving to form louvered fins having a plurality of continued flat wall portions formed by bending a thin strip in a desired pitch in a zig-zag fashion, each of the flat wall portions having a plurality of louvers extending in perpendicular to the flat wall portion, wherein: respective crests of the cutting teeth in each of the fin blades are plasma-nitrified to a depth of 20 to 60 μm, thereby forming a nitride layer on each of the crests; and depositing a coating of TiC, TiN, or TICN to a thickness of 2 μm or less over the nitride layer in accordance with a plasma chemical vapor deposition method or a plasma physical vapor deposition method. Now, the tool for manufacturing louvered fins of a heat exchanger and a surface finishing method for the tool according to the present invention will be described in detail in terms of configurations, functions and effects, as compared with those of conventional cases.

BEST MODE FOR CARRYING OUT THE INVENTION

Figure 1:
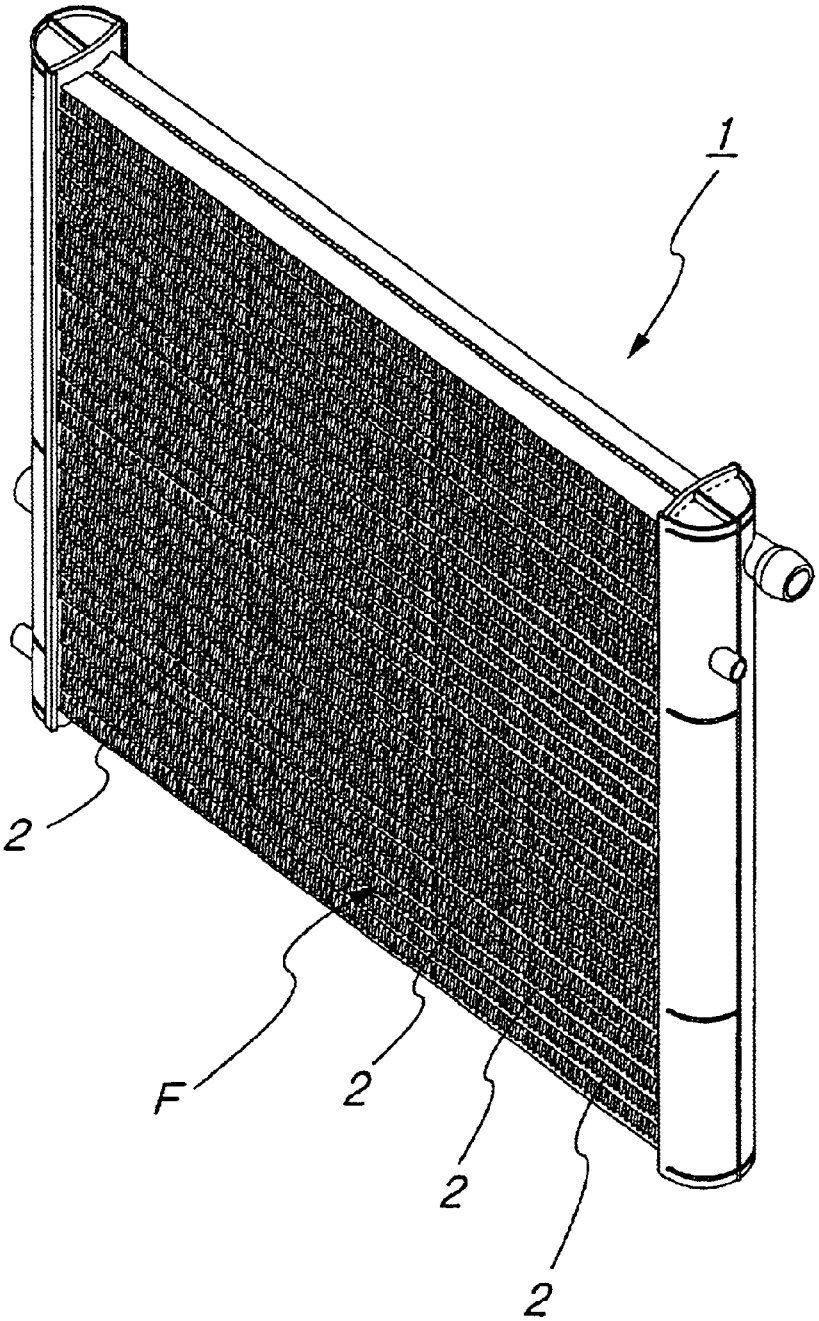
FIG. 1 is a perspective view illustrating a condenser which is an example of a heat exchanger to which the present invention is applied.
Figure 2:
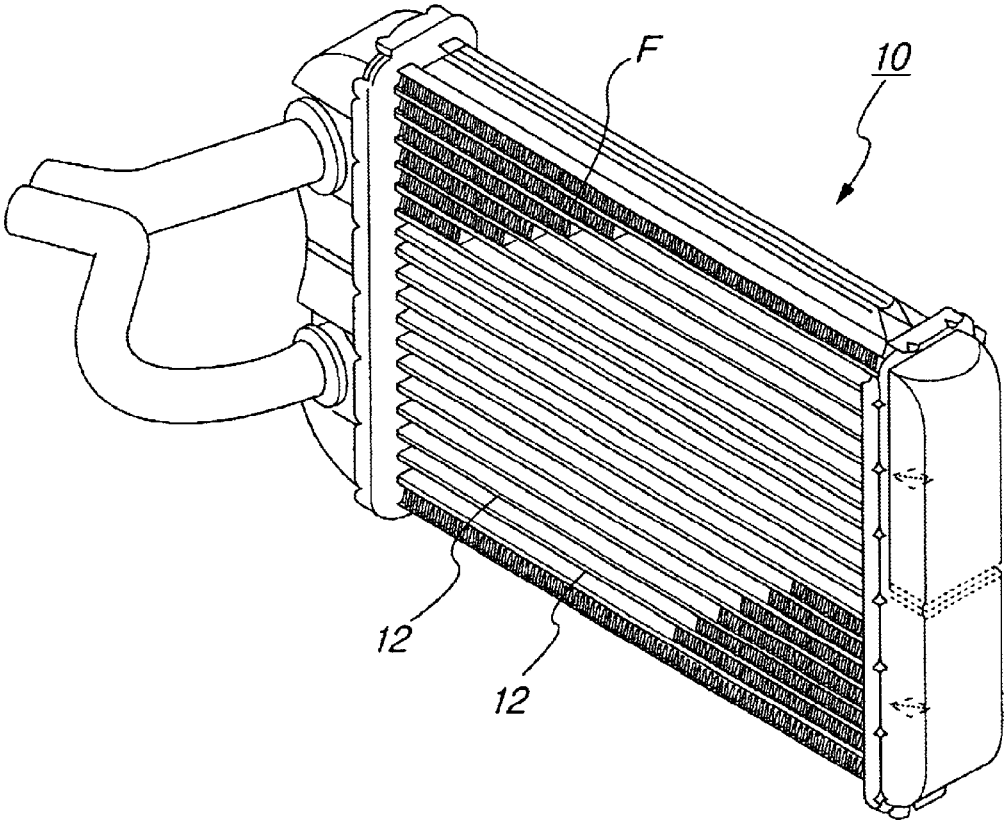
FIG. 2 is a perspective view illustrating a heater core which is another example of a heat exchanger to which the present invention is applied.
Figure 3:
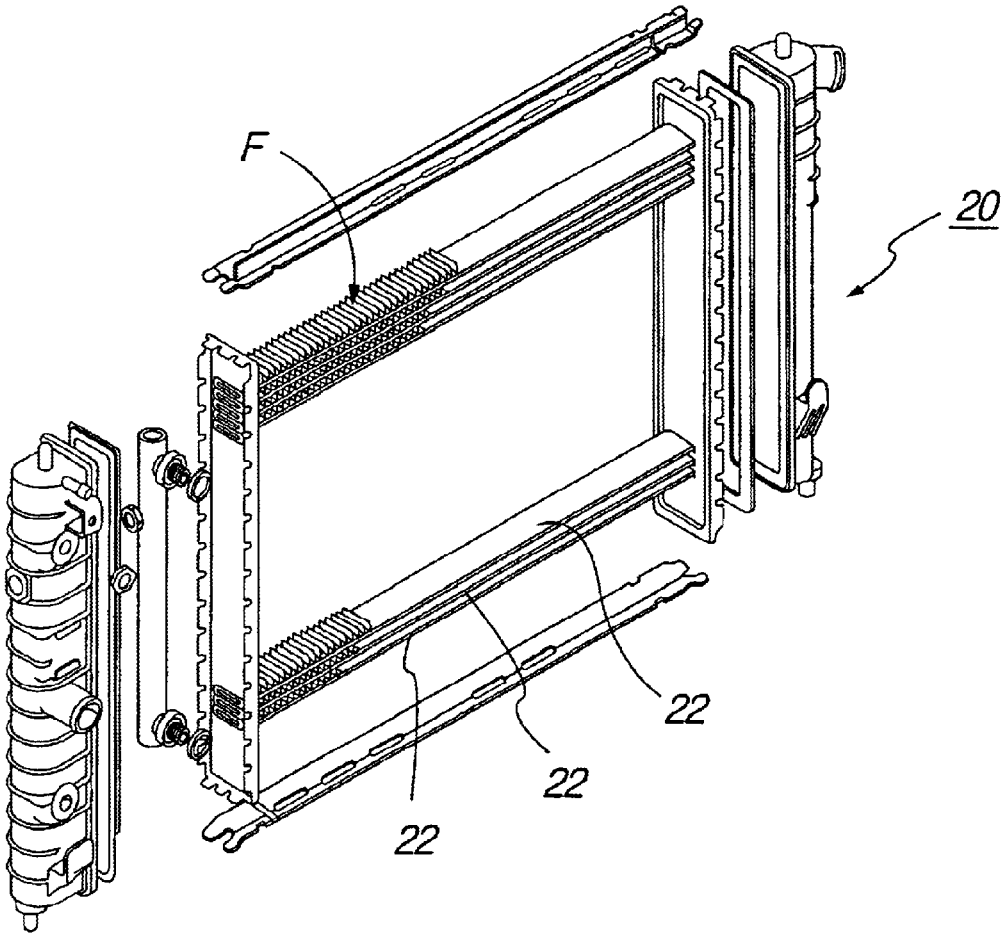
FIG. 3 is a perspective view illustrating a radiator which is another example of a heat exchanger to which the present invention is applied.
Figure 4:
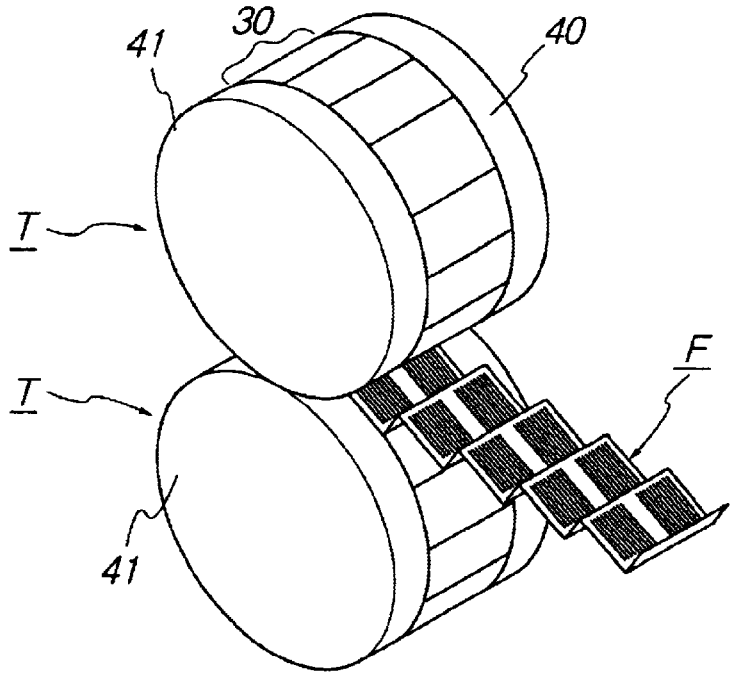
FIG. 4 is a perspective view illustrating a tool for manufacturing louvered fins of a heat exchanger having a typical configuration, and a manufacturing method using the tool.
Figure 5:
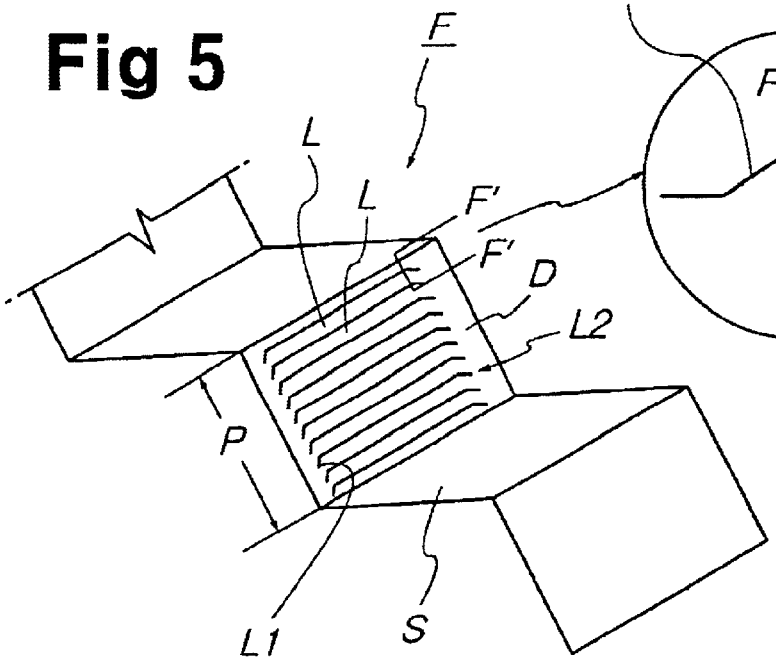
FIG. 5 is an enlarged view illustrating the typical louvered fins manufactured in accordance with the manufacturing method of FIG. 4.
Figure 6:
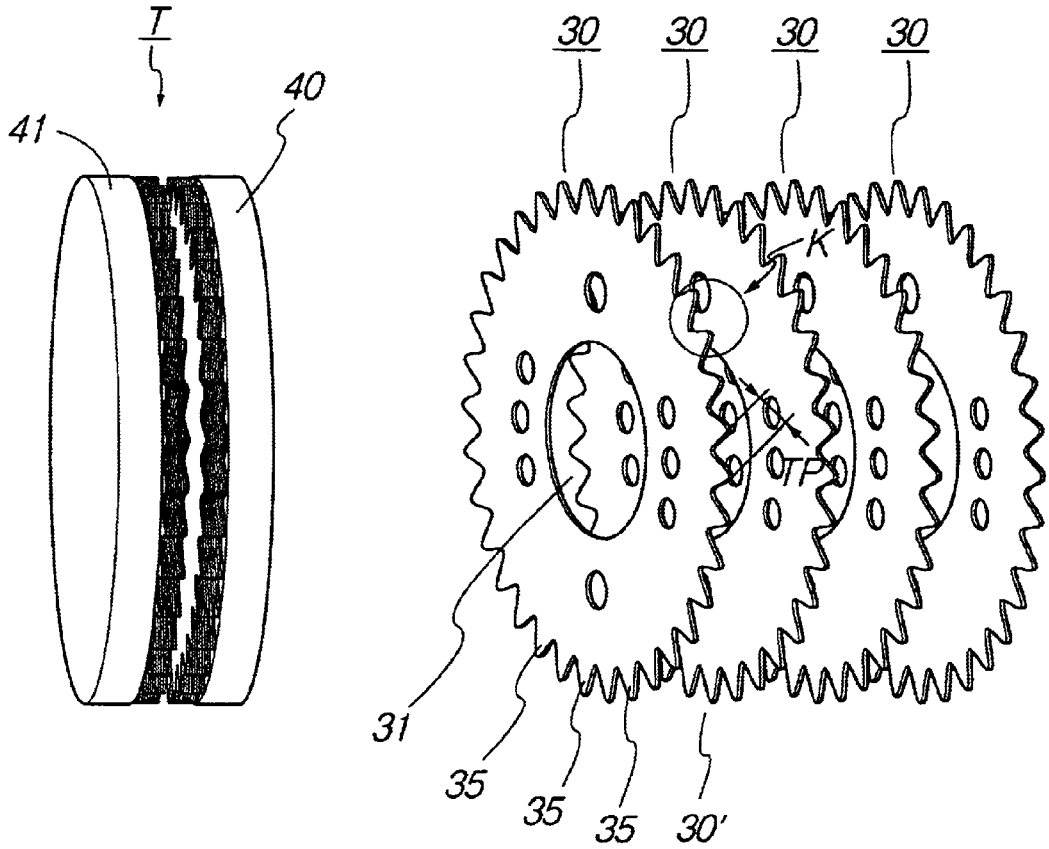
FIG. 6 is a perspective view illustrating a configuration of the louver fin manufacturing tool shown in FIG. 4, along with fin blades included in the tool.
Figure 7:
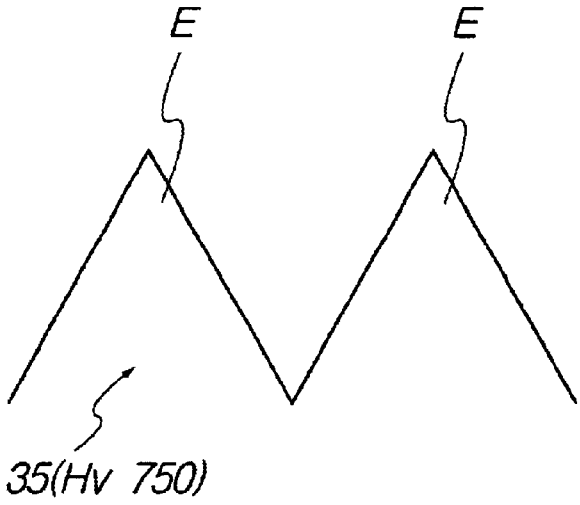
FIG. 7 is an enlarged view illustrating a cutter portion of one fin blade included in a conventional louvered fin manufacturing tool.
Figure 8:
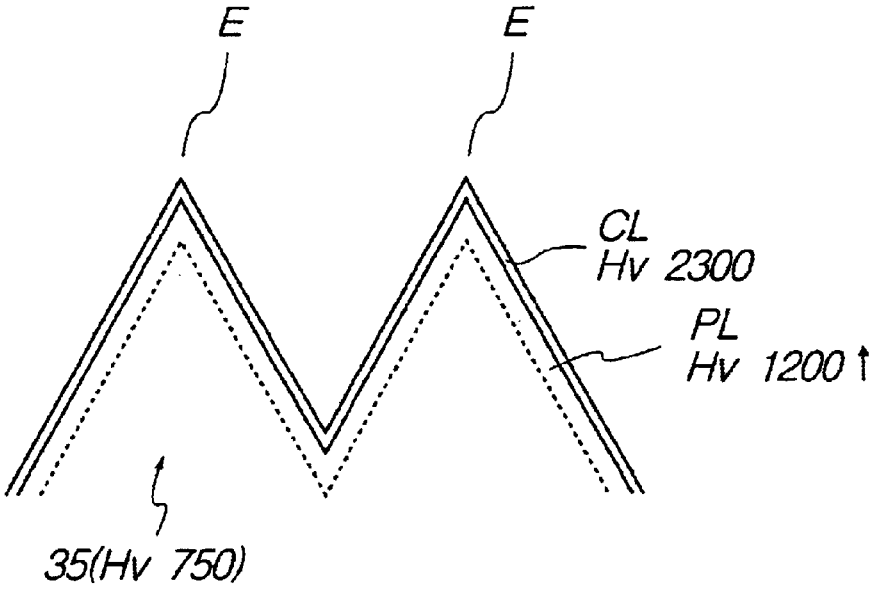
FIG. 8 is an enlarged view schematically illustrating a cutter portion of one fin blade included in a conventional louvered fin manufacturing tool.
Figure 9:
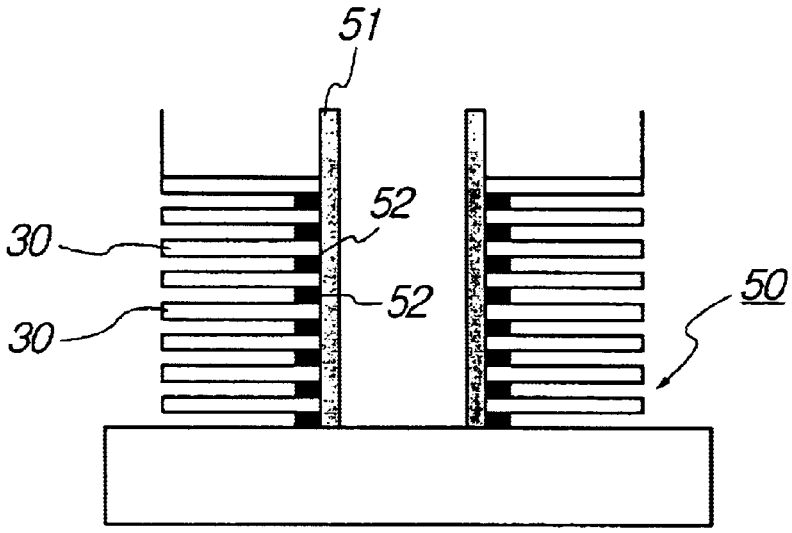
FIG. 9 is a side view illustrating a jig adapted to stack fin blades on one another for a heat treatment in a conventional case.
Figure 10:
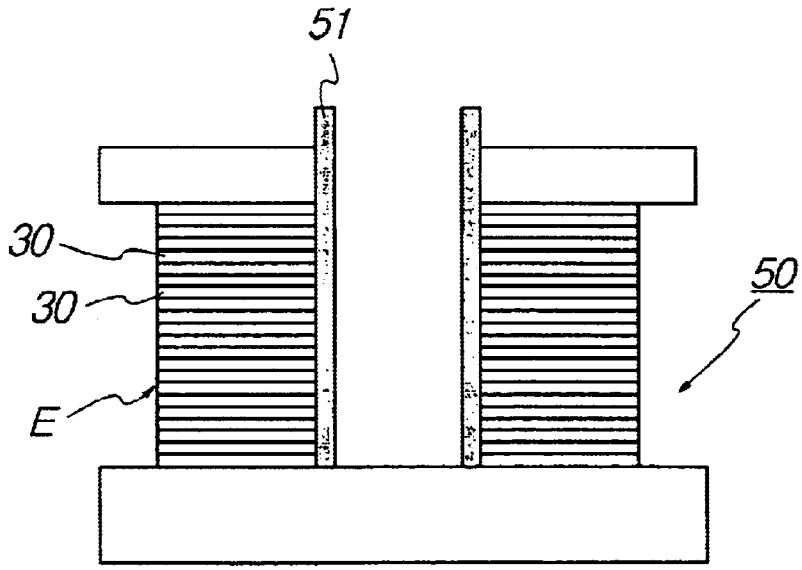
FIG. 10 is a side view illustrating a jig adapted to stack fin blades on one another for a heat treatment in accordance with the present invention.
Figure 11:
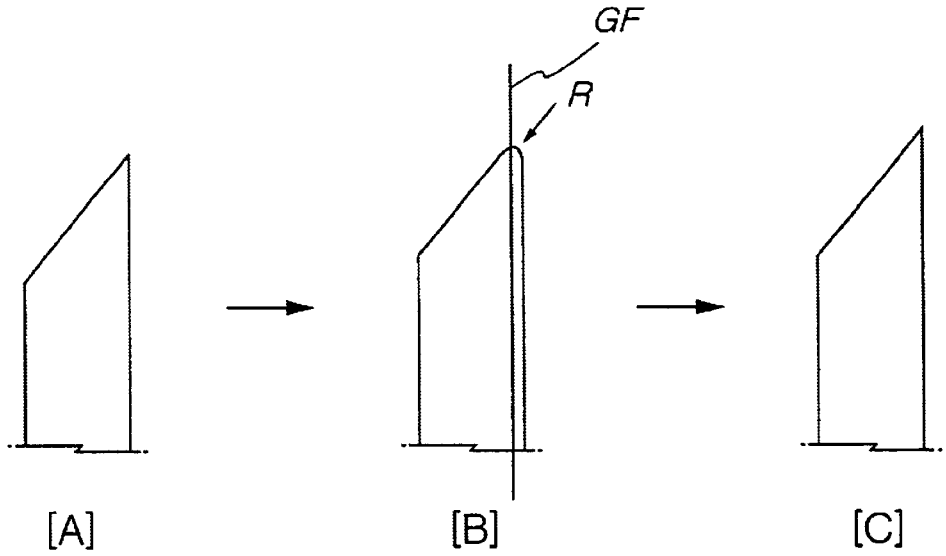
FIG. 11 is a partial enlarged view of the louvered fin manufacturing tool according to the present invention, in which the figure portion A illustrates the crest of one fin blade being in an initially manufactured state, the figure portion B illustrates the crest being in a degraded state after a repeated use thereof, and the figure portion C illustrates the crest being in a ground state.

FIG. 1 is a perspective view illustrating a condenser which is an example of a heat exchanger to which the present invention is applied. FIG. 2 is a perspective view illustrating a heater core which is another example of a heat exchanger to which the present invention is applied. FIG. 3 is a perspective view illustrating a radiator which is another example of a heat exchanger to which the present invention is applied. FIG. 4 is a perspective view illustrating a tool for manufacturing louvered fins of a heat exchanger having a typical configuration, and a manufacturing method using the tool. FIG. 5 is an enlarged view illustrating the typical louvered fins manufactured in accordance with the manufacturing method of FIG. 4, along with a cross-sectional view taken along the line F–F'. FIG. 6 is a perspective view illustrating a configuration of the louver fin manufacturing tool shown in FIG. 4, along with fin blades included in the tool. FIG. 7 is an enlarged view illustrating a cutter portion of one fin blade included in a conventional louvered fin manufacturing tool. FIG. 8 is an enlarged view schematically illustrating a cutter portion of one fin blade included in a conventional louvered fin manufacturing tool. FIG. 9 is a side view illustrating a jig adapted to stack fin blades on one another for a heat treatment in a conventional case. FIG. 10 is a side view illustrating a jig adapted to stack fin blades on one another for a heat treatment in accordance with the present invention. FIG. 11 is a partial enlarged view of the louvered fin manufacturing tool according to the present invention, in which the figure portion A illustrates the crest of one fin blade being in an initially manufactured state, the figure portion B illustrates the crest being in a degraded state after a repeated use thereof, and the figure portion C illustrates the crest being in a ground state. FIG. 12 is a cross-sectional view of one fin blade being in a surface-treated state in accordance with a conventional surface finishing method, along with a hardness graph of the fin blade, illustrating problems involved in the conventional surface finishing method.

Referring to FIGS. 1 to 3, respective configurations of louvered fins are illustrated which are used in a variety of heat exchangers and to which the present invention is applied.

FIG. 1 illustrates louvered fins F each interposed between adjacent ones of heat exchange tubes 2 in a condenser 1 having a typical configuration. FIG. 2 illustrates louvered fins F each interposed between adjacent ones of heat exchange tubes 12 in a heater core 10. In addition, FIG. 3 illustrates louvered fins F each interposed between adjacent ones of heat exchange tubes 22 in a radiator 20. A detailed configuration of such louvered fins F is illustrated in FIG. 5.

Figure 5A:
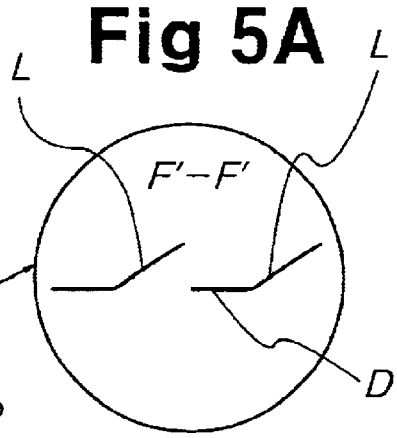
FIG. 5A is a cross-sectional view taken along the line F–F' of FIG. 5.

Each louvered fin F is formed by bending a metal sheet in a zig-zag fashion. Referring to FIGS. 5 and 5A, the louvered fin F is formed by bending a thin strip S in a pitch P in a zig-zag fashion to form a plurality of continued flat wall portions D, cutting each flat wall portion D of the strip S at a plurality of positions uniformly spaced along the length of the flat wall portion D, and then bending those cut portions from the plane of the flat wall portion D, thereby forming a plurality of parallel louvers L connected together at their ends L1 and L2.

In order to manufacture the louvered fin F having the above mentioned structure, therefore, it is necessary to use a specific tool capable of bending a thin strip S in a pitch P in a zig-zag fashion to form a plurality of continued flat wall portions D, cutting each flat wall portion D of the strip S at a plurality of positions uniformly spaced along the length of the flat wall portion D, and bending those cut portions from the plane of the flat wall portion D, thereby forming a plurality of parallel louvers L. An exemplary configuration of such a tool is illustrated in FIGS. 4 and 6.

Referring to FIG. 6, a tool T is illustrated which is adapted to manufacture louvered fins of a heat exchanger in accordance with the present invention.

As shown in FIG. 6, the tool T includes a plurality of fin blades 30 each having a circular cutter shape. Each fin blade 30 is provided at its periphery with a plurality of cutting teeth 35 arranged in a pitch TP. The fin blades 30 are fitted around a fixed central shaft (not shown) in a stacked fashion. For the fitting around the fixed central shaft, each fin blade 30 has a central hole 31. At opposite sides of the stacked fin blades 30, a pair of guide jig discs 40 and 41 are fitted around the fixed central shaft, respectively. The guide jig discs 40 and 41 serve to guide a thin strip S to be formed into a desired louvered fin F. The fin blades 30 and guide jig discs 40 and 41 are fixedly mounted to the fixed central shaft by means of fixing members such as bolts.

In order to manufacture a louvered fin, a pair of tools T having the above mentioned arrangement are used, as shown in FIG. 4. Referring to FIG. 4, the tools T are arranged adjacent to each other to define a nip therebetween. The tools T are rotated in opposite directions by a high-speed rotating mechanism (not shown), respectively. A thin strip S is introduced into the nip between the facing tools T and fed through the nip by the rotations of those tools T. As the thin strip S passes through the nip between the tools T, it is bent in a zig-zag fashion to form a corrugated structure while being simultaneously shaped to form louvers L.

Such simultaneous formation of the corrugated structure and the louvered structure is achieved by the tools T in which the cutting tooth 35 of each fin blade 30 has a pitch TP corresponding to the pitch P of the fin F, and the space between adjacent ones of the fin blades 30 corresponds to the space between adjacent ones of the louvers L.

However, the fin blades 30 of the tools T are subjected to a severe using condition in that they are repeatedly and continuously used for the repeated and continued bending and cutting processes. For this reason, the life of the fin blades may be considerably reduced.

In order to solve such a problem, efforts to increase the surface hardness of the fin blades have conventionally been made. As mentioned above, a gaseous nitrification method has been used.

Figure 12A:
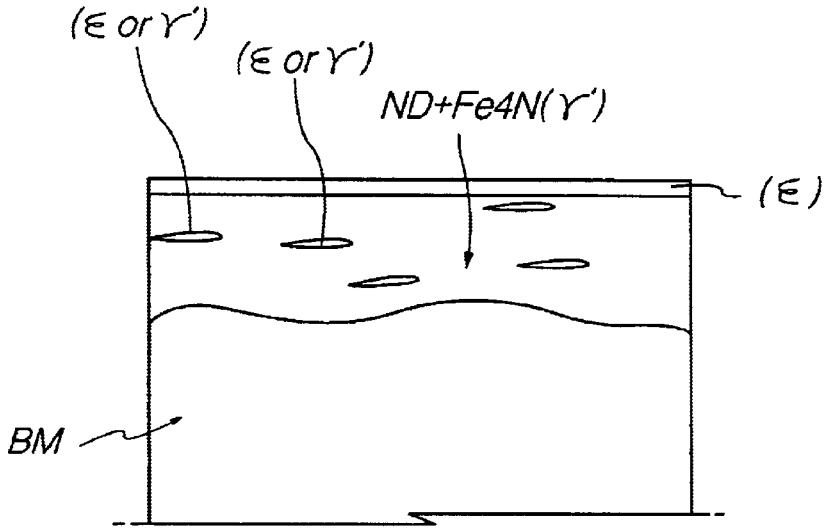
FIG. 12A is a cross-sectional view of one fin blade being in a surface-treated state in accordance with a conventional surface finishing method.

However, in accordance with such a gaseous nitrification method, a non-uniform nitrification may occur depending on different positions of the article, to be treated, in a nitrification furnace and different portions of the article. As a result, the surface-treated article may have deviations in nitrified depth and surface hardness.

Where a high-speed steel, which is used for the fin blades 30, is subjected to a gaseous nitrification, and $Fe_{2-3}C$ compound layer CM of a undesirable brittle $\epsilon$-phase may be formed to a certain thickness in addition to an intended nitrogen diffused layer ND, as shown in FIG. 12A. Otherwise, an acicular structure may be formed in the nitride layer ND. As a result, the resultant structure may be brittle. This may result in a formation of chippings during the manufacture of fin blades using the surface-treated high-speed steel. Otherwise, the material may be broken.

Figure 12B:
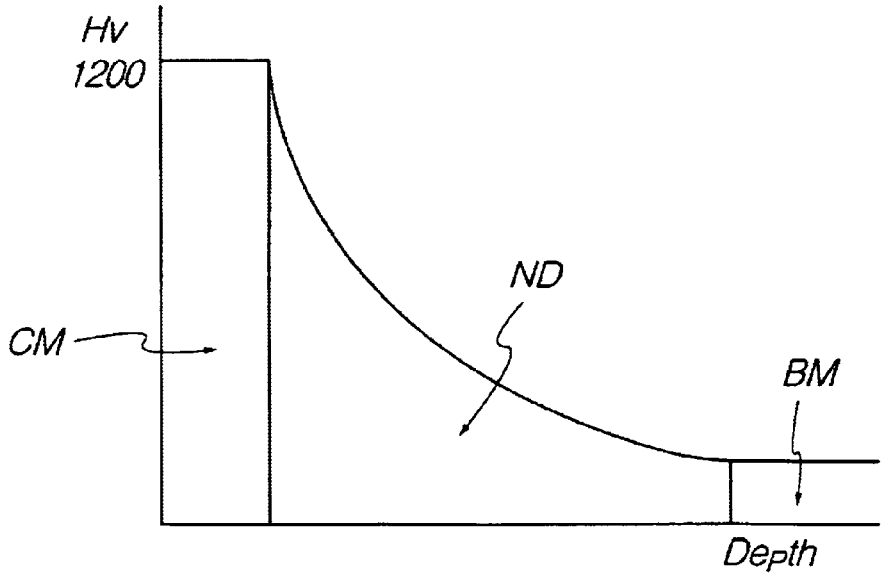
FIG. 12B is a hardness graph of the fin blade of FIG. 12A, illustrating problems involved in the conventional surface finishing method.

As shown in FIG. 12B, it is possible to obtain an increase in hardness up to Hv 1200 in accordance with the above mentioned gaseous nitrification method. However, there is a problem associated with the above mentioned brittleness. Furthermore, in this case, it is impossible or difficult to re-use fin blades manufactured in accordance with the above mentioned method because chippings may be formed when those fin blades are subjected, at side surfaces thereof, to a grinding process for the re-use thereof. In order to solve such problems involved in the conventional method, the present invention provides a specific tool for manufacturing louvered fins, and a surface finishing method for the tool. Now, the tool and the surface finishing method for the tool according to the present invention will be described in detail with reference to the following examples.

EXAMPLE 1

Each fin blade 30 of the tool T is partially subjected to a plasma nitrification under the condition in which no heat treatment is conducted. That is, only the crests E of the cutting teeth 35 in each fin blade 30 are subjected to the plasma nitrification up to a depth of 20 to 60 $\mu$m, preferably, 30 to 50 $\mu$m, without being subjected to any heat treatment, in accordance with this example of the present invention.

In accordance with this example, the plasma nitrification is carried out in a conventional fashion by filling Ar, $N_2$, $H_2$, and $CH_4$ in a vacuum chamber loaded with workpieces, that is, the fin blades 30, to be processed, and maintained at a high temperature, and then conducting a discharge in the vacuum chamber. As the discharge occurs, Ar strikes the surface of each workpiece, thereby causing Fe existing on the surface of the workpiece to be excited. As a result, a diffusion of N into the workpiece is accelerated. A part of N may react with the excited $Fe^{2+}$, thereby forming an undesirable $F_{2-3}N$ (an $\epsilon$-phase) and an undesirable $Fe_4N$ ($\gamma'$-phase). In order to avoid the formation of such undesirable $\epsilon$ and $\gamma'$-phases, the ratio of N2 and H2 contained in the atmosphere formed in the vacuum chamber is controlled in accordance with the present invention. When the ratio of N2 and H2 is ranged from 3:7 to 4:6, a nitride layer, which consists only of a nitride diffused layer, is formed in the surface of the workpiece.

In accordance with the above mentioned plasma nitrification method, a nitride layer exhibiting a substantially uniform gradient along the depth of the workpiece is formed, so that it exhibits both abrasion resistance and toughness. The discharge nitrification is conducted at a relatively low temperature of 500° C. or less. Accordingly, it is possible to prevent a variation in the physical properties of the workpiece and a deformation of the workpiece.

The reason why the plasma nitrification depth is limited to a range of 20 to 60 $\mu$m is to achieve an easy grinding for the side surfaces of the fin blade 30. After a repeated use, the crest E of each tooth in the fin blade 30 may be blunt, as indicated by the reference character R in the view B of FIG. 11. In order to re-use such a blunt fin blade 30, it is necessary to grind one side surface of that fin blade, thereby allowing the crest E of the fin blade to have a sharp edge along the grinding plane GF. Where the plasma nitrification depth is ranged from 20 to 60 $\mu$m, the grinding process can be easily conducted. In addition to such an effect for the easy grinding process, the plasma nitrification depth limited to the above mentioned range provides a great reduction in the nitrification cost.

As the crests E of each tooth in the fin blade 30 is subjected to the plasma nitrification, they exhibits a hardness increased up to Hv 1200 to Hv 1300. The nitride layer formed in the surface of the fin blade 30 consists only of a nitrogen diffused layer and a micro-precipitation phase of $Fe_4N$. In accordance with the plasma nitrification, the formation of surface compound layers of an $\epsilon$-phase or acicular compounds of $\epsilon$ and $\gamma'$-phases are substantially inhibited. Accordingly, it is possible to obtain fin blades having tooth crests E exhibiting a high hardness while being free of physical properties associated with brittleness.

For the plasma nitrification only for the tooth crest E, a jig 50 having a central shaft 51 is used, as shown in FIG. 10. A plurality of fin blades 30 to be subjected to the plasma nitrification process are fitted around the shaft 51 of the jig 50 in such a fashion that they are stacked on one another without any space between adjacent ones thereof. Where the fin blades 30 mounted to the jig 50 in the above mentioned fashion are simply loaded in the vacuum furnace, only their peripheral surfaces, namely, tooth crests, are exposed to the atmosphere in the vacuum furnace. Accordingly, the plasma nitrification can be easily conducted only for the exposed tooth crests E.

Referring to FIG. 9, a jig is illustrated which is used in conventional gaseous nitrification methods. The jig, which is denoted by the same reference numeral as that of the jig used in accordance with the present invention, that is, 50, includes a central shaft 51, and spacers 52. In order to ensure the entire portion of each fin blade 30 to be sufficiently nitrified, the spacers 52 are used which serve to space adjacent ones of fin blades 30, stacked on one another along the shaft 51, apart from each other. As compared to the conventional gaseous nitrification method using such a jig, therefore, the plasma nitrification method according to the present invention provides effects of an improvement in productivity and workability.

EXAMPLE 2

Each fin blade 30 of the tool T is partially subjected to a plasma nitrification after a desired heat treatment is conducted. That is, only the crests E of the cutting teeth 35 in each fin blade 30 are subjected to a heat treatment, and then subjected to the plasma nitrification up to a depth of 20 to 60 $\mu$m, preferably, 30 to 50 $\mu$m in accordance with this example of the present invention. In accordance with this example, it is possible to greatly enhance the mechanical strength of the fin blade 30.

This example can be used even in the case in which the material of the cutting teeth 35 exhibits a low hardness.

EXAMPLE 3

Each fin blade 30 of the tool T is partially subjected to a plasma nitrification under the condition in which no heat treatment is conducted. That is, only the crests E of the cutting teeth 35 in each fin blade 30 are subjected to the plasma nitrification up to a depth of 20 to 60 $\mu$m, preferably, 30 to 50 $\mu$m, without being subjected to any heat treatment, in accordance with this example. The plasma nitrification is carried out in the same fashion as in the first example of the present invention.

In accordance with this example, a plasma chemical vapor deposition (CVD) process or a plasma physical vapor deposition (PVD) is conducted for a plasma nitride layer formed in the surfaces of the tooth crests E of each fin blade 30, in order to achieve a coating treatment for those tooth crests E. That is, TiC, TiN, or TiCN, which exhibits a very high hardness, is deposited to a thickness of 2 $\mu$m or less over the tooth crests E in accordance with the plasma CVD or PVD method.

As a result of experiments, it could be found that the TiC, TiN, or TiCN coating deposited over the plasma nitride layer serves to increase the surface hardness of the tooth crests to Hv 2000 or more.

The reason why the thickness of the TiC, TiN, or TICN coating is limited to 2 $\mu$m or less is because that coating may be deposited in the form of a spherical structure resulting in a undesirable degradation in cut ability.

Where the TiC, TiN, or TiCN coating is directly deposited over the tooth crests under the condition, in which the above mentioned plasma nitrification is not conducted, it may be easily peeled off because an ionospheric layer may be formed at the interface between the surfaces of the tooth crest and the coating due to a great hardness difference exhibited between the surfaces of the tooth crests and the coating. For this reason, it is necessary to form a relatively thick plasma nitride layer having a hardness ranged between those of the tooth crests and coating.

Referring to FIG. 8, it can be found that a plasma nitride layer PL exhibiting a hardness of Hv 1200 or more and a coating CL exhibiting a hardness of Hv 2300 or more are formed over the cutting teeth 35 which exhibits a hardness of Hv 1200 under the condition not subjected to any surface treatment.

Industrial Applicability

As apparent from the above description, the tool for manufacturing louvered fins and the surface finishing method for the tool according to the present invention can achieve an increase in the life of the tool while allowing a grinding of the tool after a repeated use thereof, thereby allowing a re-use of the tool. The present invention also provides an improvement in treatment efficiency, thereby achieving an improvement in utility.

What is claimed is:

1. A method for finishing a surface of fin blades of a tool for an air conditioning apparatus, the tool including a plurality of fin blades each having a circular cutter shape and being provided at a periphery thereof with a plurality of cutting teeth and at a central portion thereof with a central hole, the fin blades being stacked on one another in such a fashion that the central holes are aligned together, and a pair of jig discs arranged at opposite sides of the stacked fin blades, respectively, in such a fashion that the jig discs are arranged in a coaxial and integral fashion with the fin blades, the tool serving to form louvered center fins having a plurality of continued flat wall portions formed by bending a thin strip in a desired pitch in a zig-zag fashion, each of the flat wall portions having a plurality of louvers, the method comprising the step of:

nitrifying only a crest portion of the cutting teeth in each of the fin blades to a depth of 20 to 60 $\mu$m such that a nitride layer exhibiting a hardness of Hv 1200 to Hv 1300 is diffused in each of the crests.

2. The method according to claim 1, wherein the step of nitrifying the crests is carried out by fitting the fin blades around a central shaft included in a jig in such a fashion that the fin blades are stacked on one another without any space between adjacent ones thereof, and then loading the fin blades mounted to the jig in a nitrifying furnace.

3. The method according to claim 1, wherein the step of nitrifying is carried out to a depth of 30 $\mu$m to 50 $\mu$m.

4. The method of claim 1, wherein said step of nitrifying is performed under conditions in which no heat treatment has been previously conducted for said fin blades.

5. The method of claim 4, wherein said step of nitrifying is with plasma nitrification.

6. The method of claim 5, further comprising, after the step of nitrifying with plasma nitrification, the step of depositing a coating of TiC, TiN or TiCN to a thickness of not more than 2 $\mu$m over the nitride layer.

7. The method of claim 6, wherein said step of depositing is performed using a plasma chemical vapor deposition method or a plasma physical vapor deposition method.

8.The method of claim 5, wherein said step of plasma nitrifying only the crest portions is performed by fitting the fin blades around a central shaft in a jig such that said fin blades are stacked on one another without any space between adjacent ones thereof.

9. The method according to claim 5, wherein the step of nitrifying is performed in a vacuum chamber in which a ratio of $N_2$ to $H_2$ is controlled to range from 3:7 to 4:6.

10. A method for finishing a surface of fin blades of a tool for an air conditioning apparatus, the tool including a plurality of fin blades each having a circular cutter shape and being provided at a periphery thereof with a plurality of cutting teeth and at a central portion thereof with a central hole, the fin blades being stacked on one another in such a fashion that the central holes are aligned together, and a pair of jig discs arranged at opposite sides of the stacked fin blades, respectively, in such a fashion that the jig discs are arranged in a coaxial and integral fashion with the fin blades, the tool serving to form louvered center fins having a plurality of continued flat wall portions formed by bending a thin strip in a desired pitch in a zig-zag fashion, each of the flat wall portions having a plurality of parallel louvers, the method comprising the steps of:

subjecting only a crest portion of the cutting teeth in each of the fin blades to a hardening heat treatment; and plasma-nitrifying said heat treated crest portions to a depth of 20 to 60 $\mu$m, such that a nitride layer exhibiting a hardness of Hv 1200 to Hv 1300 is diffused in each of the crests.

11. The method according to claim 10, wherein the step of plasma nitrifying the crests is carried out by fitting the fin blades around a central shaft included in a jig in such a fashion that the fin blades are stacked on one another without any space between adjacent ones thereof, and then loading the fin blades mounted to the jig in a nitrifying furnace.

12. The method according to claim 10, wherein the step of plasma nitrifying is carried out to a depth of 30 $\mu$m to 50 $\mu$m.

13. A method for finishing a surface of fin blades of a tool for an air conditioning apparatus, the tool including a plurality of fin blades each having a circular cutter shape and being provided at a periphery thereof with a plurality of cutting teeth and at a central portion thereof with a central hole, the fin blades being stacked on one another in such a fashion that the central holes are aligned together, and a pair of jig discs arranged at opposite sides of the stacked fin blades, respectively, in such a fashion that the jig discs are arranged in a coaxial and integral fashion with the fin blades, the tool serving to form louvered center fins having a plurality of continued flat wall portions formed by bending a thin strip in a desired pitch in a zig-zag fashion, each of the flat wall portions having a plurality of louvers, the method comprising the steps of:

plasma nitrifying only a crest portion of the cutting teeth in each of the fin blades to a depth of 20 to 60 $\mu$m thereby forming a nitride layer on each of the crests; and depositing a coating of TiC, TiN or TiCN to a thickness of not more than 2 $\mu$m over the nitride layer in accordance with a plasma chemical vapor deposition method or a plasma physical vapor deposition method.

14.The method according to claim 13, wherein the step of plasma nitrifying the crests is carried out by fitting the fin blades around a central shaft included in a jig in such a fashion that the fin blades are stacked on one another without any space between adjacent ones thereof, and then loading the fin blades mounted to the jig in a nitrifying furnace.

15. The method according to claim 13, wherein the step of plasma nitrifying is carried out to a depth of 30 $\mu$m to 50 $\mu$m.

* * * * *